United States Patent [19]

Guim et al.

[11] Patent Number: 5,051,731

[45] Date of Patent: Sep. 24, 1991

[54] BLOWN CIRCUIT BREAKER INDICATOR WITH LIGHT EMITTING DIODE

[76] Inventors: Raul Guim; Aurelio R. Guim, both of 834 Venetia, Coral Gables, Fla. 33134

[21] Appl. No.: 464,537

[22] Filed: Jan. 16, 1990

[51] Int. Cl.[5] ..... G08B 21/00

[52] U.S. Cl. ..... 340/638; 335/17

[58] Field of Search ..... 340/638; 335/17; 361/115, 114, 42, 45, 44

[56] References Cited

U.S. PATENT DOCUMENTS

| | | | |
|---|---|---|---|
| 3,740,738 | 6/1973 | Kosanovich et al. | 340/638 |
| 4,633,240 | 12/1986 | Guim et al. | 340/638 |
| 4,760,384 | 6/1988 | Vila-Masot | 340/638 |

*Primary Examiner*—Donnie L. Crosland
*Assistant Examiner*—Jill Jackson
*Attorney, Agent, or Firm*—Malin, Haley, McHale, Dimaggio & Crosby

[57] ABSTRACT

A circuit breaker assembly incorporating a light emitting diode as an indicator when an overload condition is present and the circuit has been blown and further wherein the assembly includes an integral, internally placed load in the form of a capacitance sufficient to energize the light emitting diode when the load normally present in the circuit has been removed. The capacitance is connected in series with the light emitting diode as well as an external ground contact for providing the ground return for energizing the light emitting diode.

14 Claims, 2 Drawing Sheets

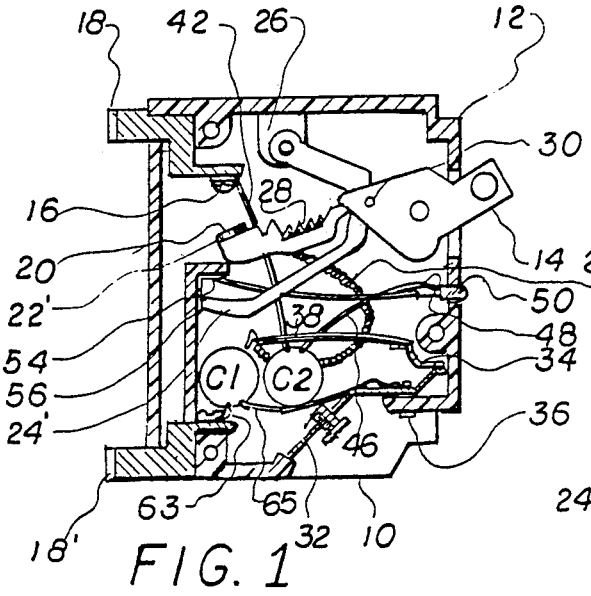
FIG. 1
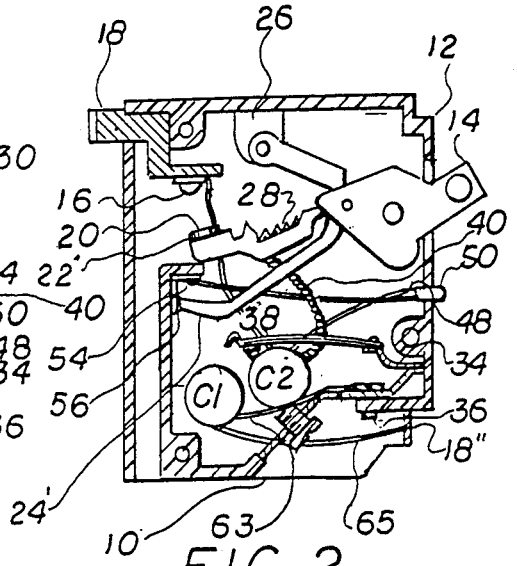
FIG. 2
FIG. 4
FIG. 3
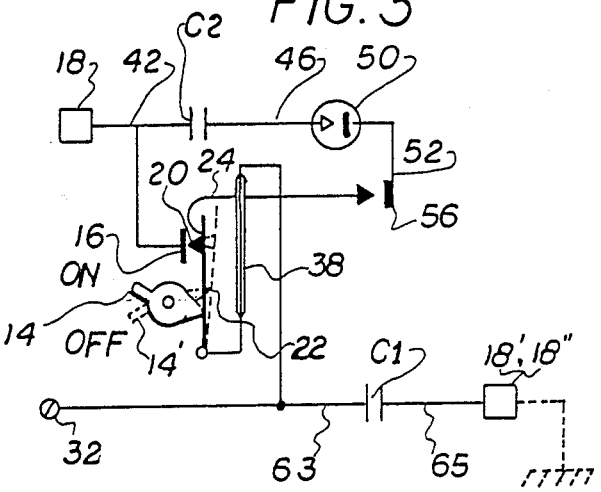
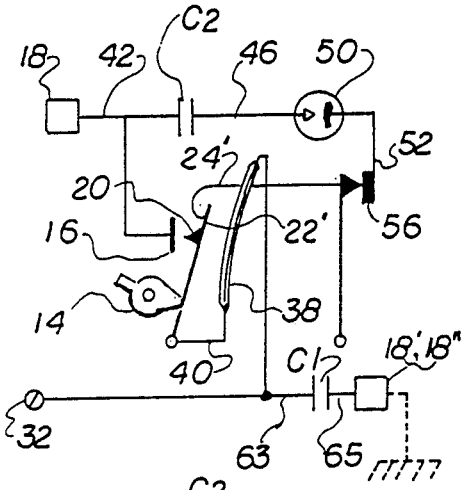
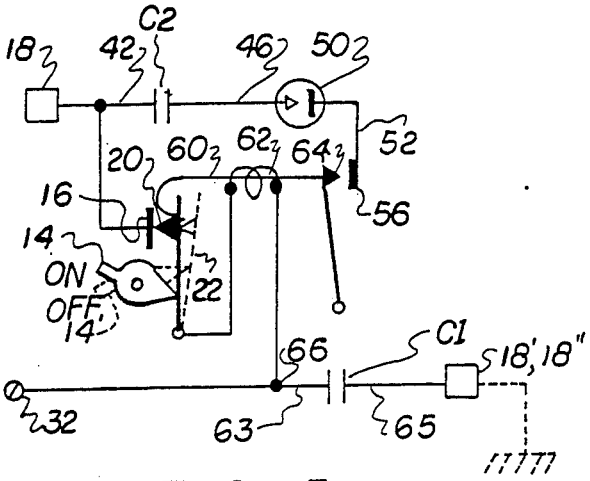
FIG. 5
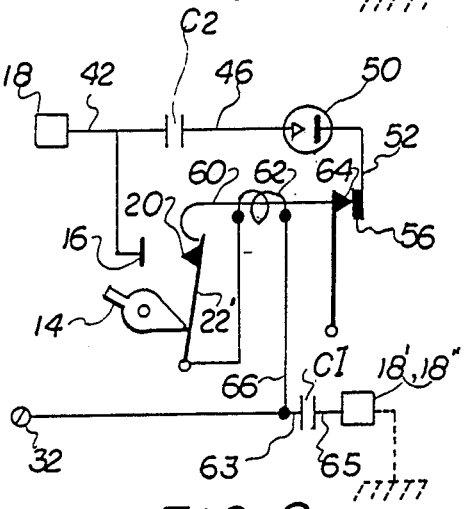
FIG. 6

BLOWN CIRCUIT BREAKER INDICATOR WITH LIGHT EMITTING DIODE

BACKGROUND OF THE INVENTION

Conventional circuit breakers are normally placed in an operative position in banks of side-by-side units with only an outwardly exposed front face and operating handle readily accessible and visually observable. The operating handle has two extreme positions, one when the circuit breaker is in circuit completing position and the other when in a circuit interrupting position. When an overload condition occurs, the circuit breaker "blows" indicating that the load circuit is interrupted by a circuit overload responsive element. This element simultaneously causes the operating handle to move to an intermediate position. When a number of such circuit breakers are in a group as they conventionally are, it is difficult to visually observe which circuit breaker has its handle in a "blown" position. This is particularly true due to most circuit breakers being located in normally out of the way locations which are frequently dark. Accordingly, it is frequently difficult to visually determine when an overload condition exists and when the circuit breaker is in its circuit interrupting position. Naturally, this is important in order to find the cause of the overload and correct such condition before resetting the circuit breaker. In order to overcome the problems as set forth above, my previously issued U.S. Pat. No. 4,056,816 is directed to a circuit breaker assembly including a light emitting diode, hereinafter designated as LED located in the same casing and viewable from an exposed face of the casing in which the circuitry of the subject circuit breaker assembly is mounted. The LED is located immediately adjacent the operating handle and is activated or illuminated and stays in such illuminated condition as long as the operating handle remains in a blown position. The indication of an interrupted circuit is therefore very easy to determine.

However, one problem recognized with the above set forth structure is that the activation or illumination of the LED is totally dependent on the presence of a load in the circuit. In the disclosure set forth in the above-noted patent, the LED circuit is in series with the connected load and this load has to be present in order to provide the ground return for engaging the LED. It is possible in some instances that certain appliances connected to a circuit breaker assembly including an LED of the type set forth above, have an internal protective circuitry or device that disconnects it from the line thereby removing the load from the LED circuit. In such instances, the LED will not be capable of indicating an overload condition.

SUMMARY OF THE INVENTION

The present invention relates to a circuit breaker assembly specifically structured to facilitate the situation of an overload condition where the circuit breaker has been "blown" through the provision of a light emitting diode. The light emitting diode is located on an exposed face or surface of the casing which is visible from outside the distribution panel in which such circuit breaker assemblies are typically mounted. The LED is activated and of course, illuminated when an overload condition occurs and when the circuit breaker has been tripped. The "blown" circuit indicator circuit including the LED is connected in parallel with the load circuit. An operating handle serving to reset the circuit breaker is mounted on the above-noted exposed face along with the LED and is structured to normally move a movable contact carrier to selectively open and close the line circuit contact.

An important improvement in the present invention is the provision of an integral load internally mounted within the casing and connected to the LED circuit or considered a part thereof. This integral load is preferably in the form of a capacitor means including a single capacitor mounted between an exterior segregated ground through a ground contact and to the LED. This capacitor is structured to supply sufficient energy to activate the LED and also provides a path to ground for the LED. It should be apparent therefore that in overload conditions, certain appliances, will have a protective feature removing themselves from the circuit thereby providing a "no-load" condition to the circuit breaker assembly. In prior art structures of the type set forth in my above-noted patent, the LED is dependent upon a load existing in the circuit before it can be illuminated. The addition of a capacitance in the manner described above will overcome the above set forth condition and provide load to the LED circuit causing illumination of the LED and facilitate an indication to an outside observer that the circuit breaker has in fact been tripped.

BRIEF DESCRIPTION OF THE DRAWINGS

For a fuller understanding of the nature of the present invention, reference should be had to the following detailed description taken in connection with the accompanying drawings in which:

FIG. 1 is an elevational view of a circuit breaker assembly including a light emitting diode indicator being part of an operating circuit and also representing the components of the subject assembly respectively in an "on" position and "off" position by solid and phantom lines.

FIG. 2 is a front elevational view similar to that of FIG. 1 but representing the subject assembly in another embodiment.

FIG. 3 is a diagram of the circuit of FIG. 1 in an "on" and "off" position.

FIG. 4 is a diagram of the blown load circuit and the LED operating circuit.

FIG. 5 is a diagram of a magnetic circuit breaker in "on" and "off" positions.

FIG. 6 is a diagram of FIG. 5 after it has blown and completed the parallel circuit to the LED.

Like reference numerals refer to like parts throughout the several views of the drawings.

DETAILED DESCRIPTION OF THE PREFERRED EMBODIMENT

Figure 7:
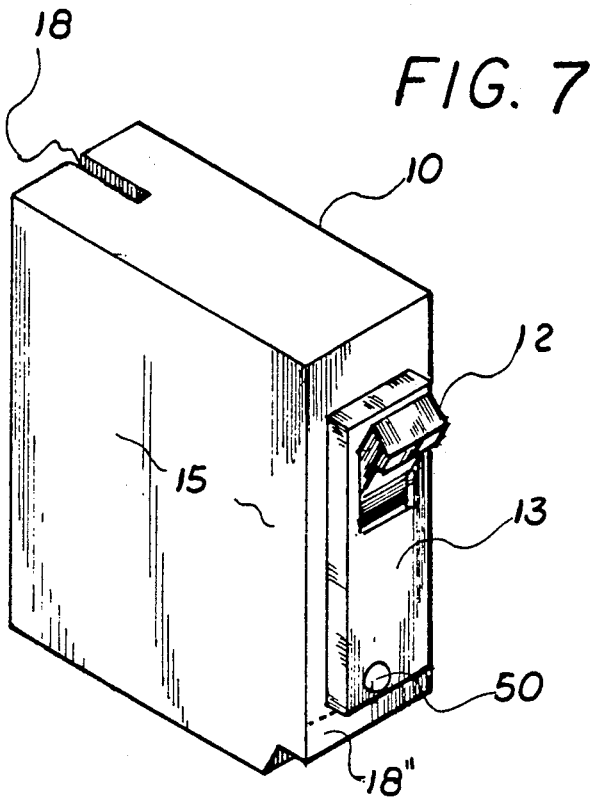
FIG. 7 is a perspective view of the exterior of the casing holding the circuitry of the subject assembly.
Figure 8:
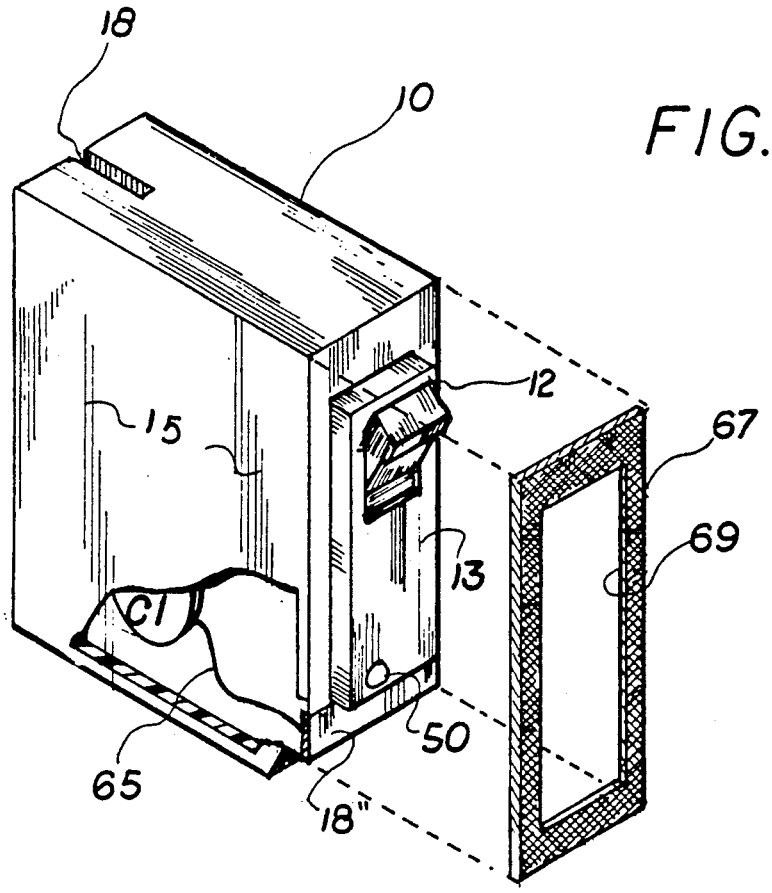
FIG. 8 is a perspective view in exploded and cutaway form showing details of a ground terminal associated with the assembly of the present invention.

The circuit breaker assembly of the present invention is shown in FIGS. 1 through 8 and includes a casing 10 formed of a molded insulating or plastic or like material. An outwardly extending end 12 of an operating handle 14 protrudes outwardly from an exposed face 13 of the casing 10 wherein the handle 14 is movably mounted within the casing 10 and held in place by a side wall of the casing 10 as indicated in FIGS. 7 and 8 as 15. The handle 14 is shown in load circuit "on" position 14. In dotted or phantom outline, the handle is shown in "off" position 14' and at 14-BP, the handle is shown in circuit breaker blown position. A fixed contact 16 is mounted on a line terminal clip 18 which is designated to engage a line bus when the circuit breaker is inserted into a distribution panel (not shown), often but not necessarily in a poorly illuminated location. A movable contact 20 is mounted on a contact carrier 22.

A trip arm 24 is pivoted on a boss 26 in the case 10 for pivoting between a set position shown in FIG. 1 and the tripped position shown in FIG. 2. An overcenter tension spring 28 has one end connected to the contact carrier 22 and the other end connected to the trip arm 24. The operating handle 14, contact carrier 22 and spring 28 form an overcenter arrangement, or toggle, which serves as an operating mechanism and urges the movable contact 20 towards the fixed contact 16 when the spring 28 is one side of the pivot point 30 shown in FIG. 1 and urges the movable contact 20 to the open position when the spring 28 is on the other side of the pivot point 30 as shown in FIG. 2. A load terminal connecting screw 32 connects the circuit breaker to a load circuit and is also positioned within the molded case 10.

The load terminal connecting screw 32 is threaded through a conductive bus bar 34 mounted within the casing 10 as at 36. The current responsive member of the overload tripping mechanism is in the embodiments of FIGS. 1 through 4, a thermally responsive or bi-metallic latching member 38 which is electrically connected to the movable contact 22 by a flexible conductor 40 or stranded wire typically made of copper material.

The thermally responsive latching member 38 is a generally hooked shaped thermostat element of at least two layers of metal having different coefficients of thermal expansion so that the element bends as its temperature increases. One end of the flexible conductor 40 is attached directly to the bi-metallic member 38 at one of its end and its other end is connected to the contact carrier 22. The other end of the bi-metallic member 38 is connected through bus bar 34 to the terminal load screw 32.

A light emitting diode (LED) is connected in a parallel circuit between the line terminal clip 18 and the load terminal screw 32. An insulated conductor 42 is connected at one end to the back of the line terminal clip 18 and at its other end is connected to a capacitor $C_2$. The capacitor $C_2$ in turn is connected through a second conductor 46 to one side 48 of the LED 50 which extends through and is counter-sunk in the exposed face 12 of the casing 10 in a manner which allows it to be prominently visible. In this instance, a capacitor $C_2$ is preferred over a conventional resistor element in that the capacitor may withstand heat and therefore provide the overall circuit breaker assembly with a longer lasting life. This may be particularly true when a bi-metallic sensing element as at 38 is utilized and wherein heat is generated therefrom within the interior of the casing 10. The other side of the LED 50 is connected by a conductor 52 to an arm 54 having a contact 56. The contact 56 provides an electric connection to the trip arm 24 when the arm has been tripped to the position 24', shown in FIG. 2. The current then passes through the trip arm 24' to the contact carrier 22, now in position 22'. The current travels from the contact arm 22' through the conductor 40 to the bi-metallic member 38 and thus, through the bus bar 34 to the load terminal screw 32 to which the load is normally connected.

An important feature of the present invention is the provision of a capacitor means in the form of a capacitor $C_1$ connected to the LED circuit by conductor 63 through the bi-metallic member 38. In addition, the capacitor $C_1$ is connected to a ground 18' or 18'' (to be explained in greater detail hereinafter) by a conductor 65. The capacitor $C_1$ therefore provides an integral load internally mounted within the casing 10 which serves to activate and provide a proper path to ground of the LED under no-load circumstances. The term "no-load" is herein meant to encompass situations wherein the load terminal screw 32 is connected to some type of appliance which includes an internally protected device that disconnects the appliance from the line under overload conditions. In such an instance, there would be "no load" supplied to the LED and without the existence of the capacitor $C_1$ providing energy to activate the LED and defining a return path to ground, the LED would be inoperable to indicate an overload condition. The capacitor rating is preferably at 2KVDC to sustain voltage ratings of the circuit breaker. The capacitor $C_1$ therefore provides sufficient energy to activate the LED while not requiring any direct power consumption.

As shown in FIGS. 1 through 8, a ground contact either 18' or 18'' is connected to the capacitor $C_1$ in order to provide ground return external to the circuit breaker assembly. In the embodiment of FIG. 1, the ground contact 18' is defined in the form of a ground terminal clamp similar to that as 18 and may further be defined as a mechanical clamp which serves to support the casing 10 as it is connected to the distribution panel.

In the embodiment of FIGS. 2, 7 and 8, the ground contact 18'' is defined by a electrically conductive material plate mounted on or adjacent to the exposed face 13 and is readily accessible therefrom. The capacitor $C_1$ is connected to the ground contact 18'' by the conductor 65, as set forth above. Another part of the embodiment of FIGS. 7 and 8 comprises an external conductor in the form of a frame 67 having a centrally apertured construction as at 69 to surround the exposed face 13 as well as the LED 50 and the exposed end or knob 12 of the operating handle 14. The external conductor 67 formed of a electrically conductive material will come into contact and engagement with the metallic plate defining the ground contact 18'. In addition, when the casing 10 is mounted in any type of conventional exterior or external housing, the metal plate will come into contact therewith (such as a metal terminal box or the like) which will serve as ground.

In the magnetic circuit breaker shown schematically in FIGS. 5 and 6, the same reference numerals are used where they apply to the same elements. In this case, there is an armature 60 extending through the magnetic coil 62. It also electrically connects the contact carrier 22 to contact 64 after the load circuit is blown. The armature 60 then completes the circuit through contact 56 to connector 52 and diode 50. When there is an overload, armature 60 pulls the contact carrier 22 to move its contact 20 away from the terminal contact 16 and moves the contact 64 into circuit completing position with contact 56. This causes the current from the line bus to pass through the connector 42 to capacitor $C_2$ 44 to conductor 46 and the LED 50 to light up and remain lit, and the circuit path then continues through the armature 60 through the contact carrier 22 and through the magnetic coil 62 and connector 66 to the load terminal screw 32.

Now that the invention has been described,

What is claimed is:

1. In a circuit breaker having a blown circuit indicator circuit, said circuit breaker having a first fixed contact connected to a line circuit, a first movable contact, a contact carrier having said first movable contact mounted thereon, an operating mechanism including a handle for manually moving said movable contact carrier so that said first movable contact may be brought into electrical contact with said first fixed contact, a load circuit terminal for connection to a load circuit, said load circuit terminal electrically connected to said first movable contact through a tripping mechanism including an overload circuit responsive member between said first movable contact and said load circuit terminal, said overload circuit responsive member for moving said contact carrier to separate said first fixed contact and said first movable contact thereby interrupting said load circuit in response to an overload condition through said overload responsive member, said blown circuit indicator circuit being connected at one end to said line circuit and at the other end to said load circuit terminal, said blown circuit indicator circuit comprising in series a light emitting diode, a second fixed contact, and a second movable contact, said second fixed contact and said second movable contact held in spaced, non-electrically conducting position by said overload responsive member until said overload responsive member is actuated to a load circuit interrupting position simultaneously moving said second movable contact into contact with said second fixed contact, thereby completing an electrical path from said line circuit to said load circuit terminal, the improvement comprising:

(a) an electrical path from said load circuit terminal through an impedence member electrically connected to a ground contact electrically connected to ground, whereby, when said overload responsive member is moved to a load circuit interrupting position in response to a load overload, said light emitting diode will become lit through a current path from said line circuit through said light emitting diode and said second movable and said second fixed contacts to said load circuit terminal, where said current path to ground is completed either through said load circuit or through said electrical path from said load circuit terminal through said impedence member and said ground contact to ground, so that said light emitting diode will be lit when said overload responsive member is moved to a load interrupting position regardless of the condition of said load circuit.

2. A circuit breaker as in claim 1 wherein said indicator circuit is connected to the line circuit and load circuit terminal and through and including a second capacitor connected in series with the light emitting diode, said second capacitor for limiting the current flowing through said light emitting didoe.

3. A circuit breaker as in claim 1 wherein said light emitting diode is located in spaced relation from the overload circuit responsive member a sufficient distance to be protected from the heat of the blown overload circuit responsive member.

4. A circuit breaker as in claim 1 wherein said overload circuit responsive member comprises a heat responsive element structured and disposed to break the circuit when there is an overload present; the improvement including the light emitting diode being physically remote from the heat responsive element to protect the light emitting diode from the heat of the heat responsive element.

5. A circuit breaker as in claim 1 wherein said overload circuit responsive member comprises a magnetic overload circuit interrupter.

6. The circuit breaker of claim 1 wherein said impedence member comprises a first capacitor.

7. A circuit breaker as in claim 6 wherein said first capacitor is mounted within a casing including an exposed face and containing said circuit breaker.

8. A circuit breaker as in claim 7 further comprising the light emitting diode being located in and visible through the exposed face of the casing and the operating handle protruding from the exposed face and being accessible thereat.

9. A circuit breaker as in claim 7 wherein said ground contact comprises a ground terminal clip mounted on said casing and disposed and structured to facilitate support of said casing when inserted into a distribution panel.

10. A circuit breaker as in claim 9 wherein said ground terminal clip is oppositely disposed and cooperatively structured with a line terminal clip disposed to engage a line bus when the circuit breaker is inserted into said distribution panel.

11. A circuit breaker as in claim 7 wherein said ground contact comprises a conductive material plate connected to the exposed face of said casing and positioned in accessible disposition to an exterior thereof.

12. A circuit breaker as in claim 11 further comprising a conductor member mounted on an exterior portion of said casing in engagement with said ground contact and an exterior housing containing said circuit breaker, said exterior housing of said circuit breaker being connected to ground thereby providing a path to ground from said ground contact, through said conductor member and said exterior housing.

13. A circuit breaker as in claim 12 wherein said conductor member is secured to said exterior portion of said casing in engagement with said ground contact and in engaging contact with said exterior housing which provides a path to ground for said light emitting diode through said first capacitor.

14. A circuit breaker as in claim 12 wherein said conductor member comprises a centrally apertured frame structure mounted in surrounding relation to an exposed face of said casing and said light emitting diode and operating handle protruding therefrom, said frame overlying said ground contact and in engagement therewith and an exterior surface of said frame engaging the exterior housing.

* * * * *